United States Patent [19]

Carver

[11] 4,218,585

[45] Aug. 19, 1980

[54] DIMENSIONAL SOUND PRODUCING APPARATUS AND METHOD

[76] Inventor: Robert W. Carver, P.O. Box 664, Woodinville, Wash. 98072

[21] Appl. No.: 27,472

[22] Filed: Apr. 5, 1979

[51] Int. Cl.[3] ..... H04S 1/00

[52] U.S. Cl. ..... 179/1 G

[58] Field of Search ..... 179/1 G, 1 GQ, 100.1 TD, 179/100.4 ST, 1 GP; 84/DIG. 27

[56] References Cited

U.S. PATENT DOCUMENTS

| | | | |
|---|---|---|---|
| 3,236,949 | 2/1966 | Atal et al. | 179/1 G |
| 4,118,599 | 10/1978 | Iwahara et al. | 179/1 G |
| 4,121,059 | 10/1978 | Nakabayashi | 179/1 G |
| 4,139,728 | 2/1979 | Haramoto et al. | 179/1 G |

FOREIGN PATENT DOCUMENTS

| | | | |
|---|---|---|---|
| 2640254 | 3/1978 | Fed. Rep. of Germany | 179/1 G |

OTHER PUBLICATIONS

"Letters to the Editors" in *Acustica,* vol. 24, 1971 pp. 222 to 225, by Damaske and Mellert.

"Head-Related Two-Channel Stereophony with Loudspeaker Reproduction", by Damaske, 1971 by Acoustical Society of America, pp. 1109–1115, *Journal of Acous. Soc. of America,* vol. 50, No. 4, Part 2.

"Some Techniques Toward Better Stereophonic Perspective" by Bauer, in *IEEE Transactions on Audio,* May–Jun. Part I 1963, pp. 88–92.

"Sound Localization in the Median Plane" by Blauert in *Acoustica,* vol. 22, 1969/70, pp. 205–213.

"Ein Verfahren . . . " by Damaske and Mellert in *Acoustica,* vol. 22, 1969/70, pp. 153 to 162.

"Sound Images Localization Controlling Technique" by Gotoh in *National Technical Report,* vol. 22, No. 4, pp. 460–466, Aug. 1976.

*Primary Examiner*—Douglas W. Olms

*Attorney, Agent, or Firm*—Hughes & Barnard

[57] ABSTRACT

A sound reproducing system having right and left speakers which transmit right and left stereo sounds, respectively. The right signal, in addition to driving the right speaker, is inverted and delayed to produce a compensating signal which is transmitted to the left speaker to produce a delayed compensating sound pattern from the left speaker. The amount of delay and amplitude of the compensating sound pattern is selected so that the major sound pattern emanating from the right speaker is at least partially cancelled at the location of the hearer's left ear. The signal for the left speaker is inverted and delayed in a similar manner to produce a compensating sound pattern from the right speaker to at least partially cancel the major sound pattern emanating from the left speaker at the location of the hearer's right ear. The result is to give the hearer a greater dimensionalized impression of the overall sound patterns.

86 Claims, 10 Drawing Figures

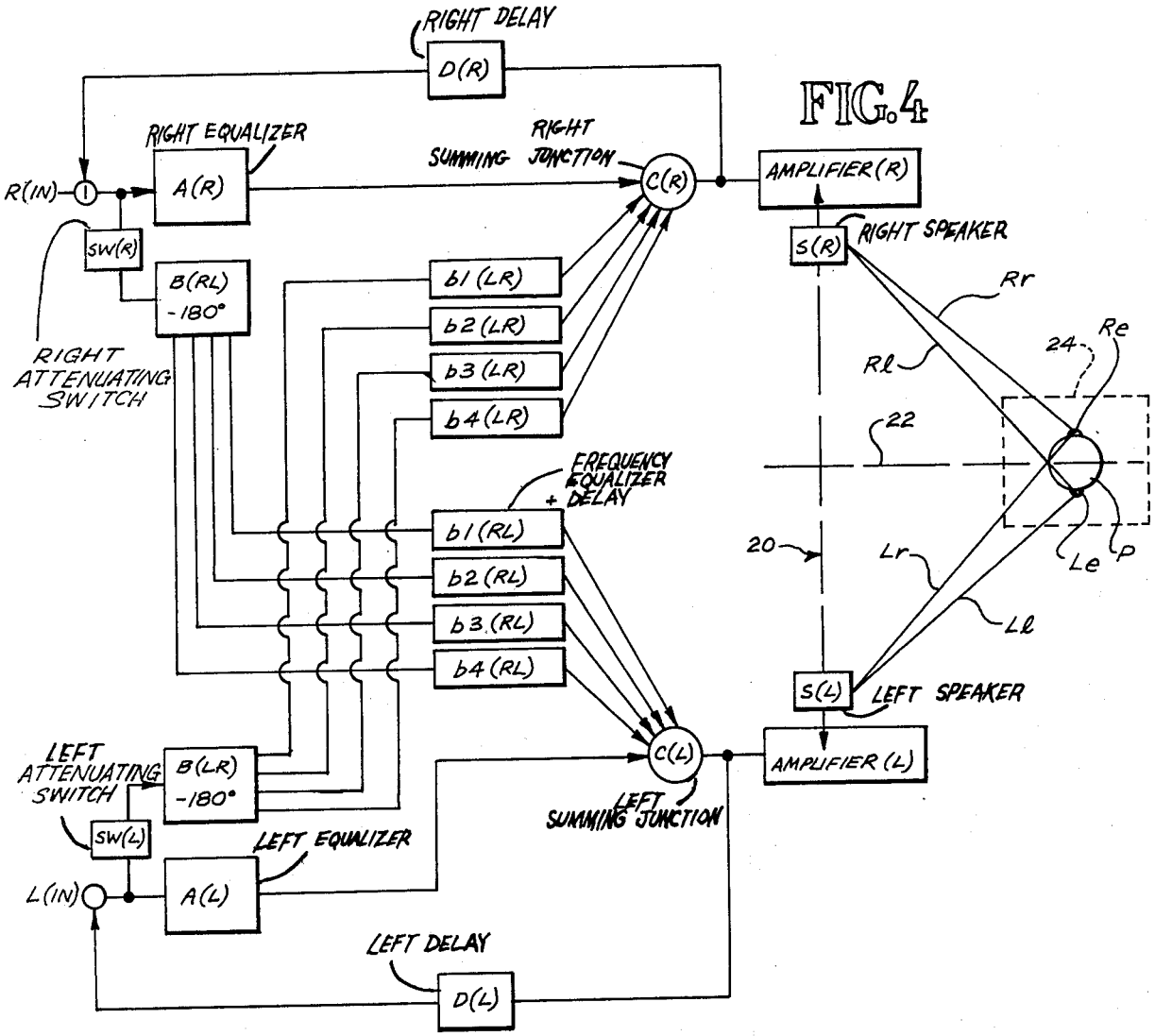
FIG. 4
FIG. 5
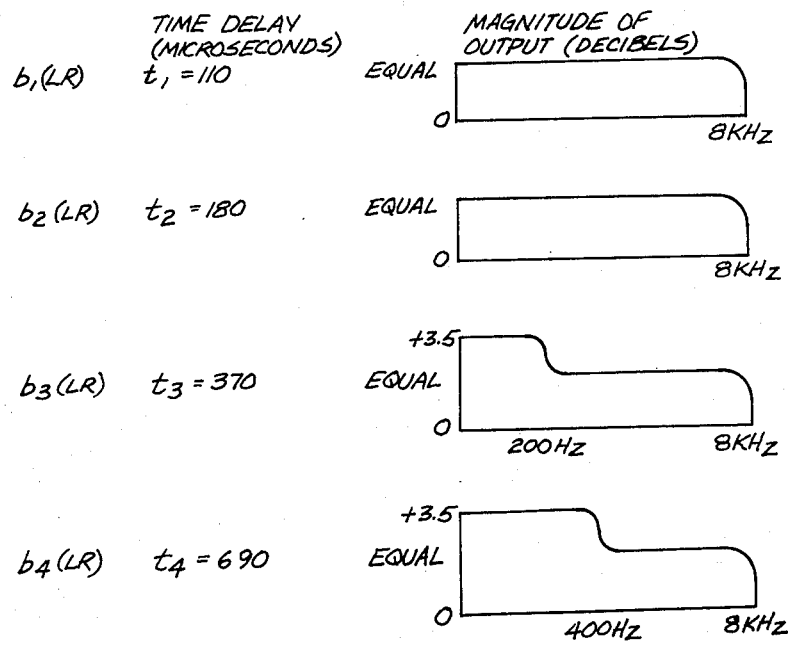

DIMENSIONAL SOUND PRODUCING APPARATUS AND METHOD

BACKGROUND OF THE INVENTION

The present invention relates to a sound producing system particularly adapted to create a dimensionalized impression of the sound.

In a typical stereophonic sound reproduction system, where there are two speakers, a "dimensionalized" effect can be obtained by transmitting different sound signals to the two speakers. Thus, with the speakers being positioned at two laterally spaced locations, and the listener being positioned rearwardly of the speakers and facing toward a location between a speakers, a distinct sound that is transmitted only from the left speaker can be detected by the listener as coming from that source since the left and right ears of the listener will detect a difference in intensity and also detect a phase shift so as to obtain the impression of the direction of the sound. When another distinct sound is transmitted from the right speaker the direction of that source of sound can also be detected by the listener. Thus, the sound can be expanded to the area encompassed by the two speakers.

There have been attempts in the prior art to give even greater dimension to the sound reproduction system, so that there is the impression that the sound is coming from areas totally outside of the more limited area at and between the two speaker locations. While the applicant is not totally familiar with the operation of these systems, according to the applicant's present understanding, such systems require rather limited conditions of operation. For example, it is known that the prior art systems known to the applicant must be utilized in an environment where there is very little reflected sound, for example in an open space, or in a room where the walls are made of a highly sound absorbent material. Further, the systems which are known to the applicant are quite sensitive to the location of the hearer's head. Thus, if the person moves his head from a precise listening location, or rotates his head moderately toward one speaker or the other, a large part of the dimensionalized effect is lost. Thus, to the best knowledge of the applicant, these systems have remained more in the category of laboratory curiosities, rather than a system which is practical for general use.

It is believed that the prior art systems discussed immediately above are operated on the basis of recognizing that sound emanating from various locations both forwardly and rearwardly of a person's head create different sound patterns relative to the person's ears. Thus, a sound emanating from a location in front of the person and 30° to the left would produce distinctly different relative sound patterns to the person's ears than a sound emanating directly from a location at the person's left. There would be a difference in intensity for the various frequencies, and also a different phase shift detected by the person's two ears. It is believed that this phenomenon is utilized to tailor or control the sound emanating from the speakers to cause delicate adjustments in the phase shift and sound intensity at different frequencies to produce the effect of greater dimensionalized sound. However, as indicated above, it is believed that the sensitivity of such systems to reflected sound and also head location have not made them practical for general use.

Also, there has been in the prior art recognition of the phenomenon called "cross talk" which in certain circumstances has the effect of degrading the quality of the sound transmitted from two spaced speakers. To describe this phenomenon briefly, the sound from a right speaker reaches both the right and left ear of the person, but reaches the left ear at a slightly later time depending on the distance between the speakers, the listening angle, and the ear spacing of the listener (e.g. at a time ranging from zero to 900 microseconds) and at a somewhat lower intensity than the sound which reaches the right ear. The sound from the left speaker acts in somewhat the same way relative to the left and right ears. With similar sounds being emitted from both speakers something of the stereophonic effect is lost or at least diminished by this phenomenon of cross talk.

This problem was recognized in U.S. Pat. No. 4,058,675, and this patent disclosed a system which has for its intended purpose the elimination of the deteriorating effect of cross talk. Since it is believed that a deeper understanding of the apparatus of U.S. Pat. No. 4,058,675 will aid in a fuller appreciation of the present invention, the apparatus will be discussed in some detail herein.

Reference is made to FIG. 1, which shows a left speaker LS and a right speaker RS at two spaced locations, and a person P at a listening location equally distant from the speakers LS and LR and located rearwardly of the speakers. The person has a left ear Le and a right ear Re.

The sound from the left speaker can be considered as having two components, namely component Ll which is transmitted from the left speaker LS to the left ear Le, and a second component Lr which is transmitted from the left speaker LS to the right ear Re. The right speaker in like manner has two sound components Rr and Rl transmitted to the right ear Re and left ear Le, respectively.

In U.S. Pat. No. 4,058,675, there is a discussion of the effect of cross talk in that the sound reaching the right ear Re from the right sound component Rr reaches the right ear shortly before the left sound component Lr reaches the right ear Re. Thus, if substantially the same sound is being transmitted from the left and right speakers, the right ear will hear the sound first at a higher intensity, and the same sound with a slightly delayed phase shift at a lower intensity. U.S. Pat. No. 4,058,675 proposes to alleviate this problem by providing additional left and right auxilliary speakers to provide cancelling sounds to eliminate cross talk. This will be explained with reference to FIG. 2, labelled "Prior Art" and corresponding to FIG. 5 of U.S. Pat. No. 4,058,675.

It can be seen that there is a left speaker LSP, made up of a main left speaker MSL and a left subspeaker SSL. The left signal L enters at the terminal "IN", and is transmitted directly to the main left speaker MSL. In addition, the left signal is applied through an attenuator AT and phase shift and delay means DP to the subspeaker SSL. In like manner, the right speaker SPR has a main speaker MSR and subspeaker SSR, along with an attenuator AT and delay means DP.

In the operation of the device of U.S. Pat. No. 4,058,675, the main sound component Ll from the main left speaker MSL reaches the left ear Le substantially undiminished. Also, there is a main sound component (not shown herein for clarity of illustration) from the main right speaker MSR to the right ear Re. However, the second sound component Rl from the right main speaker reaches the left ears El slightly later than the main right sound component reaches the left ear and also later than the left main sound component Ll reaches the left ear. The delayed and inverted signal SLl from the left subspeaker SSL is timed at a predetermined phase signal and directed at a predetermined intensity to substantially cancel the right second component Rl. Thus, the cross talk from the right speaker MSR is substantially attenuated. The operation is substantially the same with respect to the right ear, so that the left ear hears sounds mainly from only the left speaker, while the right ear hears sounds mainly from the right speaker.

While the applicant has not conducted an exhaustive analysis of the device shown and described in U.S. Pat. No. 4,058,675, the analysis and limited experimental evaluation which was done indicates that such apparatus has significant limitations in producing a truly dimensionalized sound effect. The reasons for this will become more apparent from the following detailed description.

In view of the foregoing, it is an object of the present invention to provide a method and apparatus to produce a greater dimensionalized sound effect, which method and apparatus would be practical for general use.

SUMMARY OF THE INVENTION

The apparatus of the present invention is provided to produce a dimentionalized audio signal to be used in conjunction with a pair of speakers where, the following conditions exist:

a. there is a playing area
b. in said playing area there is a forward transmitting area where there are right and left speakers positioned at right and left speaker locations on a base axis and spaced from one another on said base axis by a speaker spacing distance,
c. there is a longitudinal axis positioned equally distant from said speaker locations and perpendicular to said base axis,
d. there is a listening area at the center of which is a listening location positioned on said longitudinal axis rearwardly of said base axis,
e. there is a right listening axis extending from said listening location to said right speaker location at a right listening angle to said longitudinal axis,
f. there is a left listening axis extending from said speaker location to said left speaker location at a left listening angle to said longitudinal axis
g. there are right and left ear locations corresponding to right and left ear positions of a person's head which could be located at said listening location and facing forwardly along said longitudinal axis to said base axis, said right and left ear locations being spaced from one another by an ear spacing distance.

The apparatus comprises a left input means to receive a left stereo signal and a right input means to receive a right stereo signal. There are left and right output means to produce audio signals for, respectively, the left and right speakers.

There is a left main transmitting means to transmit a left main signal component, corresponding an similar to the left stereo signal, to the left signal output means. In like manner, there is a right main transmitting means to transmit a right main signal component, corresponding to and similar to the right stereo signal, to the right signal output means.

There is left to right compensating means adapted to receive the left stereo signal to produce an inverted and delayed left to right compensating signal, corresponding to the left stereo signal, and to transmit said left to right compensating signal to the right signal output means. In like manner, there is right to left compensating means adapted to receive the right stereo signal to produce an inverted and delayed right to left compensating signal corresponding to the right stereo signal, and to transmit the right to left compensating signal to the right signal output means. The two compensating signals are delayed relative to corresponding main signal components by a time delay period within a predetermined time delay range.

Thus, the left signal output means produces a left audio signal comprising the left main signal component and the right to left compensating signal. The right signal output means produces a right audio signal comprising said right main signal component and said left to right compensating signal. The result is that when the left audio signal drives the left speaker and the right audio signal drives the right speaker, the following occurs:

a. there is a left audio output having a main left sound component and a right to left compensating sound component, said left audio output having a primary path component from said left speaker to said left ear location, and a secondary path component from said left speaker to said right ear location,
b. there is a right audio output having a main right sound component and a left to right compensating component, said right audio output having a primary path component from said right speaker to said right ear location, and a secondary path component from said right speaker location to said left ear location,
c. the main left sound component reaches the left ear without being substantially diminished,
d. the right main sound component reaches the right ear location substantially undiminished,
e. the main left sound component travelling its secondary path to said right ear location is substantially diminished by the left to right compensating sound component travelling on the primary path from said right speaker to said right ear location
f. the main right sound component travelling on the secondary path from said right speaker to said left ear location is substantially diminished by the right to left compensating sound component travelling from said left speaker along the left primary path to the left ear location.

The result is that a person positioned so that the person's head is at the listening location facing along the longitudinal axis toward the transmitting area hears a dimensionalized sound with apparent sound sources being outside of the transmitting area of the two speakers.

There is for each time delay period a time delayed distance, which is that distance that sound travels during the corresponding time delay period. The apparatus is further characterized in that the time delay range for the compensating signals has a smaller time delay limit with a corresponding smaller time delay limit distance, and a larger time delay limit having a corresponding larger time delay distance limit. The smaller and larger time delay distances encompass a range which includes an optimum time delay distance equal to a value obtained by multiplying the sine of either listening angle times the ear spacing distance.

Desirably, each of the compensating signals has a plurality of compensating signal components, each having a different corresponding time delay distance component. Desirably at least one of these time delay distance components is smaller than the optimum time delay distance. Also, desirably at least one other of the time delay distance components is greater than the optimum time delay distance.

In the preferred form, at least some of the compensating signal components have decibel values lower than a decibel value of the corresponding main sound component. Also, at least one of the compensating signal components has a decibel value which varies with frequency, with lower frequencies of that compensating signal component having a higher decibel value than at higher frequencies of that compensating signal component.

The left and right main transmitting means comprises, in the preferred form, frequency equalizer means. Each of the frequency equalizer's produces its main signal component with a higher decibel lever for lower frequencies and a lower decibel level for higher frequencies.

Preferably there are right and left feedback means to receive respective right and left feedback signals from the left and right signal output means, respectively. These transmit feedback signals to, respectively, the left and right input means. The feedback signals are delayed by a time period at least as great as a time delay period of the compensating signals. In the preferred form, the time delay period for the feedback means is greater than the time delay period for the compensating signals.

Desirably, at least some of the time delay distances of the compensating signal components are between one and twelve inches. Preferably, one of the time delay distances is between one to three inches. Alternately, at least one of the compensating signal components has a time delay distance between two to four inches. As a further alternative, at least one of the compensating signal components has a time delay distance between three to seven inches. As a final alternative, at least one of the compensating signal components has a time delay distance between six to twelve inches. In the preferred form, there are four compensating signal components, each having a related time delay distance between, respectively, the following ranges, one to three inches, two to four inches, three to seven inches, and six to twelve inches.

Each of the compensating means comprises inverting means to produce an inverted signal and a plurality of frequency equalizers to delay an inverted signal from the inverting means to produce compensating components of different time delay distances.

In the method of the present invention, left and right stereo signals are directed into left and right input means, respectively. A left main signal component, corresponding and similar to the left stereo signal, is transmitted to a left signal output means. A right main signal component, corresponding to and similar to the right stereo signal, is transmitted to a right signal output means.

There is produced from the left stereo signal an inverted and delayed left to right compensating signal, corresponding to the left stereo signal. This is transmitted to the right signal output means. There is also produced from the right stereo signal an inverted and delayed right to left compensating signal, corresponding to the right stereo signal. This is transmitted to the right signal output means.

The effect of the present invention is to produce a highly dimensionalized sound with a relatively high tolerance to head position and angle of the listener. Other features will become apparent from the following detailed description.

BRIEF DESCRIPTION OF THE DRAWINGS

FIG. 2 is a schematic view of the prior art apparatus disclosed in U.S. Pat. No. 4,058,675, Kobayashi et at;

Figure 4A:
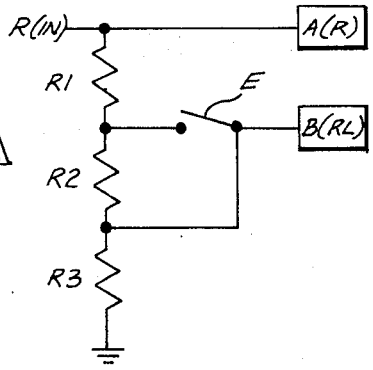
FIG. 4 is a schematic illustration of the apparatus of the present invention.

FIG. **4*a* is a scehmatic diagram of a switch in the apparatus of FIG. 4**.

Figure 1:
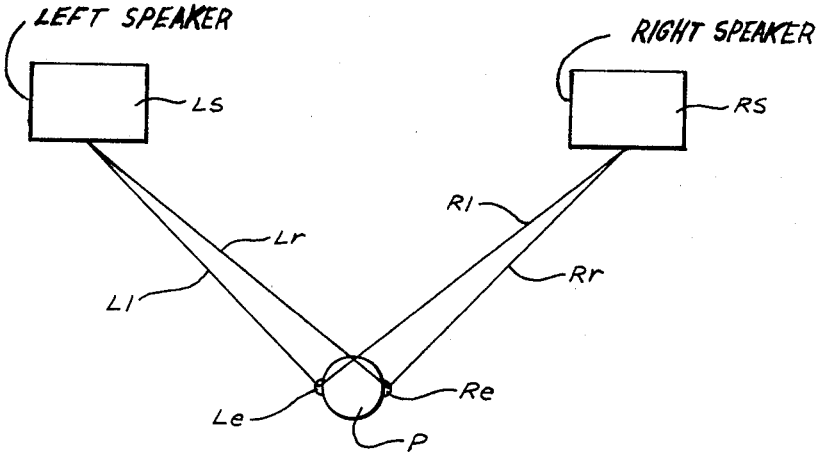
FIG. 1 is a schematic view showing the manner in which a person receives sound waves from the speakers of a typical audio stereo system.
Figure 2:
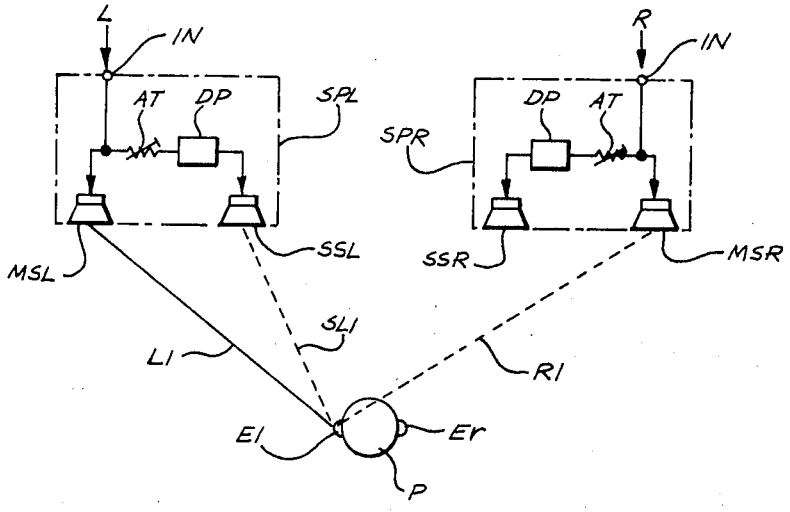
FIG. 2 PRIOR ART
Figure 5A:
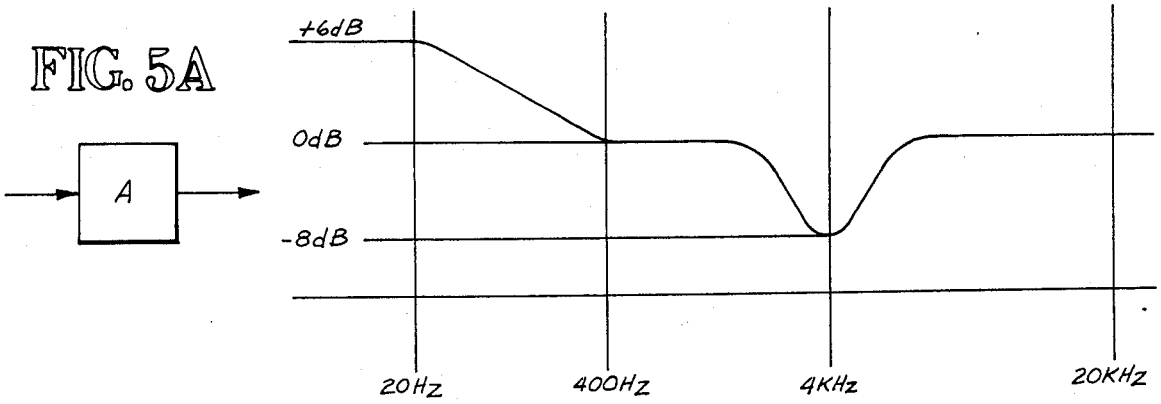
Figure 6:
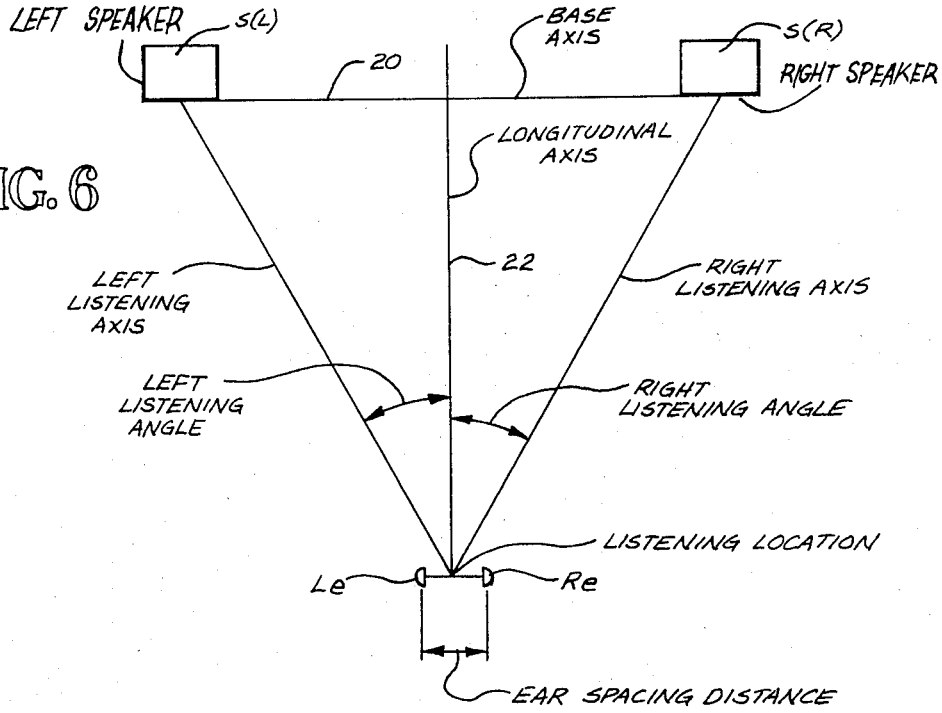
Figure 7:
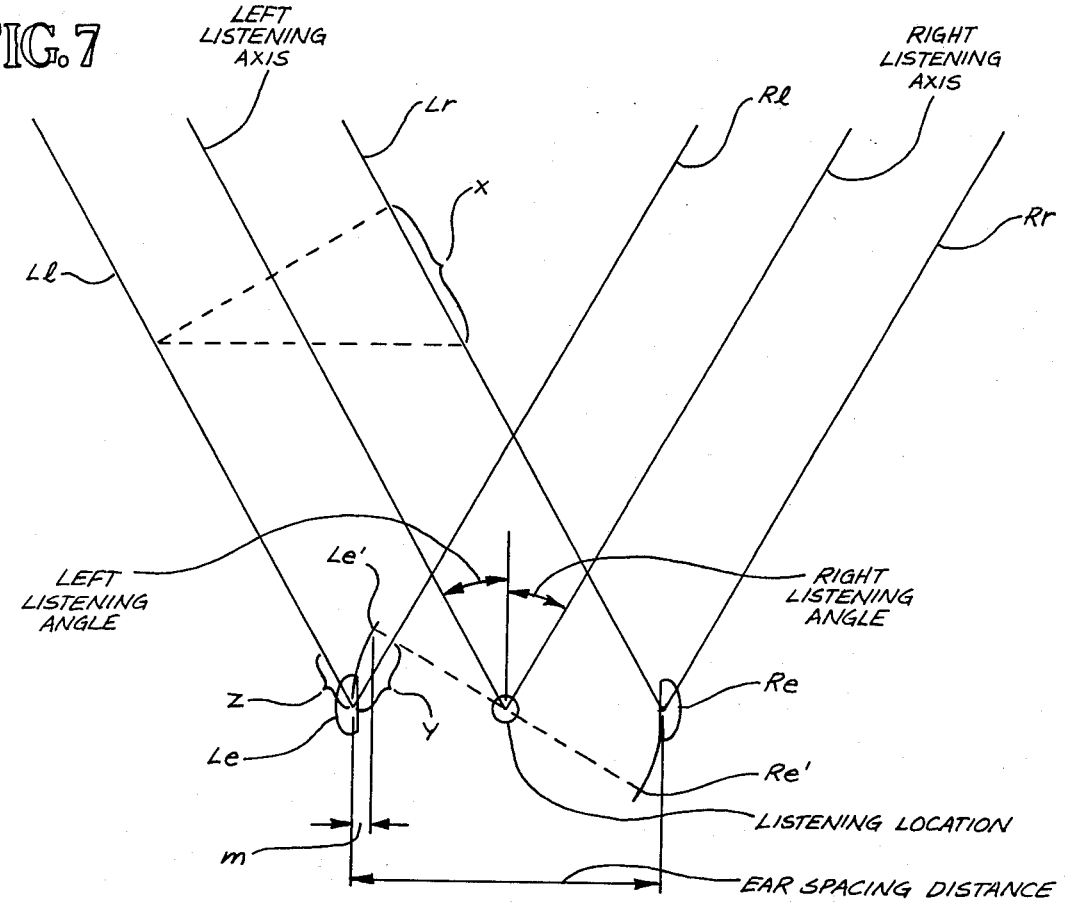
Figure 8:
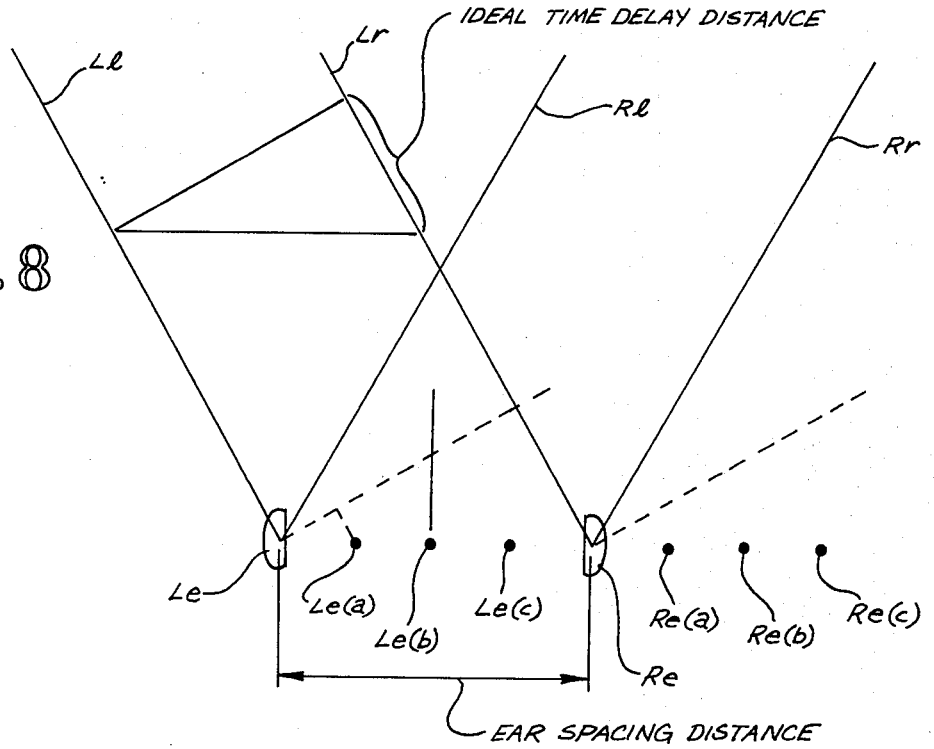

FIG. 5 is a table illustrating the magnitude of the compensating signal output components of the compensating signal;

FIG. 5A is a graph illustrating the intensity of the main signal component, as a function of frequency, produced by each of the frequency equalizers producing the main signal component;

FIG. 6 is a schematic showing, similar to FIG. 1, to illustrate operating features of the present invention;

FIG. 7 is a view of the listening area of FIG. 6 to illustrate other operating features of the present invention, FIG. 8 is a view similar to FIG. 8, showing further operating features of the invention.

DESCRIPTION OF THE PREFERRED EMBODIMENT

To appreciate the novel features of the present invention, it is believed that a detailed description of the present invention should be preceded by a general analysis of the sound patterns which are utilized in stereophonic recordings. This will be discussed by analyzing first how higher quality stereophonic recordings are made, and reference is made to FIG. 3 for this portion of the explanation.

(a) Analysis of Stereophonic Recordings

Figure 3:
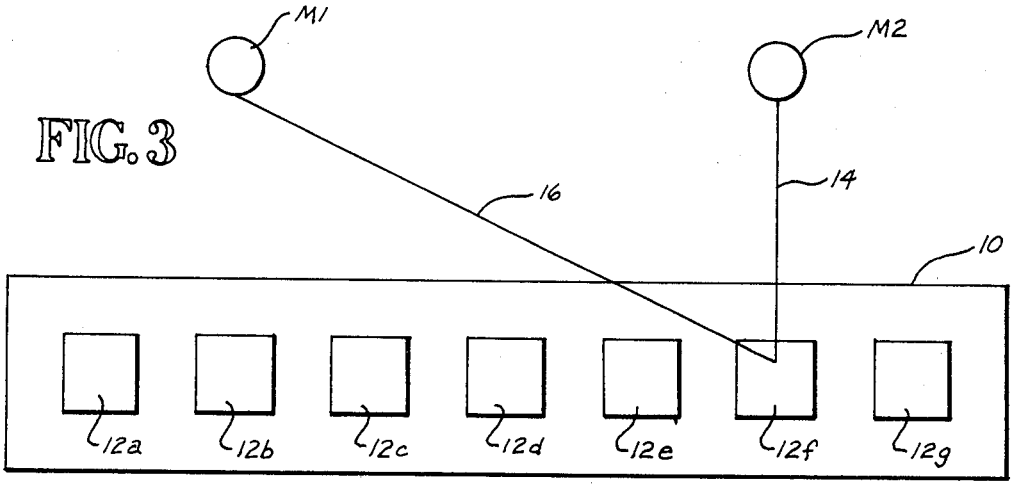
FIG. 3 is a schematic view illustrating the manner in which high quality stereo recordings are made.

In FIG. 3, there are shown two microphones M1 and M2 spaced from each other and positioned in front of an orchestra, indicated generally at 10, and comprising a plurality of orchestral components (i.e. musical instruments **12*a* through 12*g*). Let it be assumed that the two microphones M1 and M2** are positioned relatively close to the orchestra and spaced from each other by moderately more than ten feet.

The sound from instrument **12*f* travels on a first shorter path 14 to microphone M2, and on a second longer path 16 to microphone M1. Obviously the microphone M2 will record the sound from instrument 12*f* at a higher intensity than will the microphone M1. Also, there will be a phase shift in that the microphone M1 may pick up the sound in the order of approximately 1/100 of a second later than the microphone M2, since the sound must travel further to the microphone M1**.

In like manner, the sound emanating from the instrument **12*b* would reach the microphone M1 sooner and at a higher intensity than the sound from the instrument 12***b* would reach the microphone M2. At some intermediate location, e.g. at the location of the instrument 12*d*, the sound would reach the two microphones M1 and M2 at approximately the same time and same intensity. The sound transmitted to the microphone M1 is used to produce a first signal which in turn is reproduced in the recording in a manner that when the recording is played, this signal, corresponding to the sound at microphone M1, reproduces in one of the speakers a sound which is a substantial reproduction of the sound reaching the microphone M1. In like manner, the sound reaching the microphone M2 is recorded in a manner that when a recording is played, the signal driving the other speaker corresponds to the sound transmitted to the microphone M2.

Let us now discuss the situation when these two distinct sound signals are played on a recording and reproduced in a stereophonic system, with reference being made to FIG. 1. Let it be assumed that the signal produced at the microphone M2 is used in a manner to produce sound in the left speaker LS, while the signal produced at the microphone M1 is used in the recording to produce a sound in the right speaker RS.

With regard to the sound produced by the instrument 12*f* of FIG. 3, the speaker LS will first reproduce this sound at the higher intensity level. As indicated previously this sound would have first and second components Ll and Lr reaching the left and right ears, Le and Re, respectively. At that instant, the two ears Le and Re would detect a difference in intensity of the two sound components Ll and Lr and also a phase shift of possibly 100 to 300 microseconds so that there would be a very definite sense of direction from the left speaker LS. However, about 1/100th of a second later, essentially the same sound produced originally from the instrument 12*f* would be reproduced from the right speaker RS at a lower level of intensity, along the two components Rl and Rr. If the sounds from the two speakers LS and RS were of equal intensity, there would be no stereophonic effect. However, with the sound from the left speaker LS being of greater intensity, there is something of the stereophonic effect, but this is obscured to some extent by a very similar sound eminating from the right speaker RS.

Consideration is now given to the sounds emanating from the centrally located instrument 12*d*. As indicated previously, since the distances from the instrument 12*d* to the two microphones M1 and M2 are substantially equal, the timing and intensity of the sounds at M1 and M2 are substantially the same.

Thus, when the sound from the instrument 12*d* is reproduced in the two speakers LS and RS, the sounds from the two speakers LS and RS traveling the main path components Ll and Rr reach the left and right ears Le and Re simultaneously. The two secondary sound components, Lr and Rl, reach the two ears Le and Re simultaneously, but possibly 100 to 300 microseconds later than the main sound components Ll and Rr.

Let it now be assumed that with respect to the reproduced sound corresponding to that produced from the instrument 12*d*, the two secondary sound components Lr and Rl are both cancelled, so that the Le hears only a left main sound component Ll and the right ear Rr hears only the right main component Rr. With the two ears hearing substantially the same sound at the same intensity, there will be the impression that the sound is coming from a central location immediately forward of the person P. In the apparatus of the U.S. Pat. No. 4,058,675, it is possible to obtain the cancellation of the secondary sound components Lr and Rl, where the sound corresponds to the sound eminated from the instrument 12*d* (i.e. where the sound from the two speakers LS and RS are in the same phase relationship and at the same intensity). However, where the two sounds correspond to those originating from the instrument 12*f* or 12*b*, (where the two sound components are reproduced at substantially different intensity and with one sound being delayed substantially from the other), there would be no cancellation of the secondary sound components Lr and Rl by use of the apparatus of U.S. Pat. No. 4,058,675 since the inverted and delayed sound from the sub speaker would be so far out of phase from a corresponding sound from the opposite main speaker. However, since there is a substantial difference in sound intensity, there would still be something of the stereophonic effect when using the speaker system of U.S. Pat. No. 4,058,675, in the same manner as with a typical stereophonic system.

(b) Theory of the Present Invention

To proceed now to a discussion of the present invention, the present invention is based upon the theory that two corresponding sounds (i.e. sounds which emanate from the same originating instrument in the making of the initial recording) which corresponding sounds are recorded in sequence (i.e. this occuring when the instrument is closer to one recording microphone than the other) can be utilized to produce a dimensionalized effect much broader than the area occupied by the speakers. In fact, these sounds can be utilized to produce a nearly total dimensionalized effect where it appears that the music is in a sense "surrounding" the listener.

While the theory which is to be proposed below is believed to account properly for the phenomenon of the present invention, it should be stressed that regardless of the accuracy or validity of the following theory, it has been found that the present invention is able to produce this nearly total dimensionalized effect of the sound.

To proceed further with the presentation of the theory of the present invention, and with further reference to FIG. 1, let it be assumed that two sounds corresponding to those emanating from the instrument 12*f* are now reproduced in the two speakers LS and RS. With the sound picked up from the microphone M2 being reproduced through the speaker LS, the sound of the instrument 12*f* is transmitted at an earlier time along the two path components Ll and Lr. As indicated previously, in the first instant where the two sound components Ll and Lr reach the ears Le and Re, there is something of a dimensionalized effect in that the hearer distinctly has the impression that the sound is emanating from the speaker LS.

However, let it be assumed that the secondary sound component Lr is somehow eliminated so that in that first instant, only the left ear Le hears the sound which is travelling along the major sound component path Ll. With the right ear Re hearing nothing of that sound, the instantaneous impression created on the person P is that the sound has emanated from a location which is more nearly immediately to the left of the person P. Thus, the immediate impression is that the sound is totally out of the speaker area and is somewhere near the left side of the person.

About a hundredth of a second later, let it further be assumed that the reproduced sound corresponding to that of instrument 12*f* is now emitted from the right speaker RS. Let it further be assumed that the secondary sound component Rl is eliminated so that only the right ear Re hears the sound emanating from the speaker Rs. The impression is that there is a second instrument 12*f* positioned in some area immediately to the right of the person, which also is outside the speaker area.

Let us now give consideration to the sound that is reproduced which corresponds to the sound emanating from the instrument 12*d*. With the two secondary path components Lr and Rl being totally eliminated, and with the sound being emitted from the speakers LS and RS at substantially the same time and at substantially the same intensity, there is the very clear impression that the sound corresponding to that emanating from the instrument 12*d* is from a source immediately forward of the person. With regard to sounds emanating from the instruments 12*c* and 12*e*, since the difference in distance from these instruments to the microphones M1 and M2 is somewhat less, the time delay and difference in intensity with which these sounds are recorded are somewhat less than in the case of the instruments 12*b* and 12*f*. Consequently, the reproduction of these sounds in the two speakers LS and RS is timed somewhat closer together so that the left ear and the right ear Le and Re hear these two closer to the same intensity and somewhat closer together in a time frame. Thus, the dimensionalized effect with regard to the sounds corresponding to those emanating from the instruments 12*e* and 12*c* can be presumed to be somewhat less than in the case of sounds emanating from the instruments 12*b* and 12*f*.

The overall effect of this is a rather startling creation of the impression that the sound is "totally dimensionalized", in that the hearer somehow appears to be "within the sound" or in some manner surrounded by the various sources of the sound. Further, it has been found that in the present invention, the apparatus can be so arranged that it is not overly sensitive to the position or angle of the listener's head. For example, let it be assumed that the hearer is attracted more to a sound which appears to be coming in the direction from the left and the hearer turns his head toward that speaker. The dimensionalized effect created by the present invention is not substantially diminished. Further, the hearer is able to shift his head moderately from side to side, without the dimensionalized effect being substantially diminished. When the hearer moves his head a further distance to the side (e.g. a foot or so), the dimensionalized effect is diminished, but not totally eradicated. Thus, the person is able to sense this and move his head back to the ideal listening area, and continue to have comfortable angular movement of the head and moderate side to side movement while still enjoying the dimensionalized effect of the apparatus.

(c) Apparatus of the Present Invention

The apparatus of the present invention is illustrated in FIG. 4. There are left and right stereo signals entering at terminal L(IN) and R(IN), respectively, and these are in turn transmitted directly to left and right frequency equalizers, designated A(L) and A(R), respectively. Each of these frequency equalyzers A(L) or A(R) is or may be any one of those well known in the prior art, and each functions to control the power of the output as a function of frequency. The output from the frequency equalizer A(L) is directed to a summing junction C(L) and thence through an amplifier (L) to the left speaker S(L). In like manner, the output from the right frequency equalizer A(R) is directed through a right summing junction C(R) to a right amplifier (R) to drive a right speaker S(R).

Additionally, the left stereo input from L(IN) is directed to an inverting device B(LR) which inverts the phase of the signal at L(IN) by 180°. The output from the inverting device B(LR) is in turn transmitted through four channels to four time delay frequency equalizers, designated b1(LR), b2(LR), b3(LR), b4(LR), respectively. Each time delay frequency equalizer, b1(LR)–b4(LR) has two functions, first, to change magnitude of the inverted signal as a function of frequency, and secondly to delay the signal by a predetermined amount of time.

The collective output of the four time delay frequency equalizers b1(LR) through b4(LR) provides a compensating signal which is transmitted to the right summing junction C(R). This left-to-right compensating signal is superimposed over the main right stereo signal output from the right frequency equalizer A(R), and this combined signal in turn drives the right speaker R(S). Thus the output from the speaker RS is a sound pattern corresponding to the combined output from the summing junction CR.

In like manner, the right stereo input signal at R(IN) is transmitted through an inverting device B(RL) which inverts the signal by 180°. The output from the inverting device B(RL) is transmitted along four channels to a second set of four time delay equalyzers, designated b1(RL), b2(RL), b3(RL), and b4(RL). As with the other time delay frequency equalyzers b1(LR) through b4(LR), the function of the second set of time delay frequency equalizers b1(RL) through b4(RL) is to provide a right to left compensating signal that is transmitted to the left summing junction C(L). The compensating signal transmitted to the right summing junction C(L) is superimposed over the main left stereo output from the frequency equalizer A(L) to provide a combined signal which drives the left speaker L(S).

The intensity of each compensating signal is controlled by a related switch, Sw(L) or Sw(R), interposed between the input L(IN) or R(IN), respectively, and the related inverter B(RL) or B(LR), respectively. This switch Sw(L) or Sw(R) is illustrated somewhat schematically at FIG. 4A, where there are three voltage dividing resistors R1, R2 and R3 in series. When the switching element E is open, the signal is delivered to the related inverter B(RL) or B(LR) at a lower intensity, i.e. about six decibels below the level of the signal at L(IN) or R(IN). When the switch element E is closed, the intensity of the compensating signal is increased to about three decibels below the signal at L(IN) or R(IN). Thus the switches Sw(R) and Sw(L) act as "injection switches" to either increase or decrease the intensity of the compensating signal to increase or decrease the dimensionalized effect of the sound produced.

Additionally, the output from the left summing junction C(L) is fed back through a left time delay device D(L) back to the left input junction L(IN). In like manner, the output from the right summing junction C(R) is fed back through a right time delay means D(R) to the right input terminal R(IN). It should be understood that each of the components indicated above are conventional components well-known in the electronics art, and each may be provided in any one of a number of conventional forms. For example, in a book entitled "Operational Amplifiers, Design and Applications", by Jerald G. Graeme, Gene E. Tobey and Lawrence P. Huelsman, published by McGraw-Hill Book Company, copyrighted 1971, such frequency equalizers are discussed in Chapter 5, entitled "Phase Compensation." Also such devices are described in a book, entitled "Linear Applications Handbook", sold by Radio Shack, and identified by Cat. No. 62-1373, particularly on page AN 64-9. Accordingly, a detailed description of each of these components is not included herein.

As indicated previously herein, the first set of time delay frequency equalizers b1(LR) through b4(LR) is to provide a delayed signal output, the intensity of which is modified as a function of frequency. The manner in which this is done is illustrated in the table of FIG. 5. It can be seen in FIG. 5 that the output from b1(LR) is delayed by a time increment t1 of 110 microseconds. Also, the magnitude of the output from t1 is equal to the input to the inverter B(LR) up until a frequency of 8 KHz is reached, after which the output is Zero. With respect to the second time delay frequency equalizer b2(LR), the time delay t2 is 180 microseconds. The magnitude of the output is similar to the unit b1(LR).

With regard to the third time delay frequency equalizer b3(LR), the period of delay t3 is 370 microseconds. The time delay period t4 of the fourth time delay frequency equalizer b4(LR) is 690 microseconds. With regard to the magnitude of the output of these two components, component b3 (LR) has for frequencies up to 200 Hz an output of 3.5 decibels above the input to the inverter B(LR). For the fourth time delay frequency equalizer b4(LR), for frequencies up to 400 Hz, the output is 3.5 decibels above the level of the input to the inverter B(RL). For each of the components b3(LR) and b4(LR), after the initial plus 3.5 decibel output the output returns to a level equal to the input to inverter B(LR) until the frequency of 8 KHz is reached, after which the output drops to Zero. The action of the second set of time delay frequency equalizers b1(RL) through b4(RL) is identical to the first set, so the table of FIG. 5 is intended to apply to the second set as well.

It has also been found that the performance of the system of the present invention can be enhanced by controlling the intensity of the left main signal and right main signal as a function of frequency. The manner in which this is done is illustrated in the graph of FIG. 5A, where the intensity of the sound emitted from each frequency equalizer A(R) and A(L) is plotted against frequency. It can be seen that the intensity of the sound produced is at a maximum at 20 Hz, where it is 6 decibels above the incoming signal at L(IN) or R(IN). Then it declines at a substantially constant rate to a level at 400 Hz, where there is no amplification of the signal. This intensity remains constant until it approaches the 4 KHz range where the intensity of the sound declines to minus 8 decibels below the incoming signal level, after which sound level climbs back up to the ordinary level, and remains at this level until it reaches the 20 KHz range.

(d) General Operation of the Present Invention

To describe the operation of the present invention let us now place a person P at a location rearwardly of, and equally distant from, the two speakers S(L) and S(R). To establish a proper frame of reference, let it be assumed that the two speakers S(R) and S(L) and the person P are in what can be termed a "playing area", with the speakers S(L) and S(R) being at a forward location, and the person P being at a rear location. The two speakers RS and LS are positioned along a base axis 20, and spaced from each other a predetermined spacing distance. There is a longitudinal axis 22 perpendicular to the base axis 20 and equally distant from the locations of the speakers S(R) and S(L). The person P is located at a "listening area 24", which is that area immediately surrounding the head of the person P. The head of the person P is located at a "listening location" which is a location on the longitudinal axis 22 at the ideal listening position for the apparatus. The person P has a right ear Re and a left each Le.

To describe the operation of the present invention, let us examine first a very short time increment of an audio signal which enters the left stereo input L(IN). This increment of sound is directed immediately to the left frequency equalizer A(L), the output of which is called the "left main signal", which is directed to the summing junction C(L). At the summing junction C(L) there is also an increment of sound which originated from the right input R(IN) and passed through the inverting device B(RL) and through the four time delay frequency equalizers, b1(RL) through b4(RL), to the summing junction C(L). This additional sound increment can be termed a "left-to-right compensating signal". Since the time delay for each of the four time delay frequency equalizers b1(RL) through b4(RL) are different from one another, the sum total of this left-to-right compensating signal is made up of separate signal portions received in sequence at the input R(IN). The invention is so arranged that the overall effect of the compensating signal, being superimposed on the main signal from the frequency equalizer AL, is not sufficiently great to cause any noticeable degradation of the main signal from the frequency equalizer A(L).

When this combined signal increment (i.e. the left main signal with the superimposed right-to-left compensating signal) passes from the summing junction C(L) to the left speaker S(L), for purposes of analysis the sound emitted from the speaker can be considered as traveling on two sound path components, one primary path component Ll which is transmitted to the left ear Le of the person P, and a secondary path component Lr which is transmitted to the right ear Re. The left main sound on path component Ll reaches the left ear Le with no significant interference, so that the left ear Le hears a substantially undiminished left main sound resulting from the signal increment passing into the left stereophonic input L(IN).

However, this is not the case with the main left sound on the secondary path component Lr. It will be noted that the secondary path component Lr to the right ear Re is moderately longer than the primary path component Ll. The main left sound traveling the secondary path Lr is partially cancelled by the sound originating from a left-to-right compensating signal which originates from the left stereophonic input L(IN) crossing over to the right summing junction CR by passing first through the inverter B(RL) and the four time delay frequency equalizers b1(LR) through b4(LR). The left-to-right compensating signal creates a compensating sound at the right speaker S(R) which is superimposed over the sound created by the main right signal delivered to the right speaker S(R). The sound from the speaker S(R) travels over a right primary path component Rr and over a right secondary path component Rl.

With the path component Rr being shorter than the left secondary path Lr, the left-to-right compensating sound is delayed to the extent that the left-to-right compensating sound reaches the right ear Re at approximately the same time as does the left corresponding main sound increment traveling along the secondary path component Lr. Since the compensating sound is 180° out of phase by reason of the inverter B(RL), the compensating sound at least partially cancels out the main left sound increment traveling the secondary path Lr. The net effect is that the left ear Le hears the left main sound increment substantially undiminished, while the right ear Re hears the left main sound increment very little or at a substantially diminished level.

With regard to the right-to-left compensating signal which originates in the right input R(IN), and is transmitted to the left speaker S(L), it was stated earlier that this signal is superimposed on the left main signal L(IN) which is transmitted from the frequency equalizer A(L) to the left speaker. However, when the superimosed portion of the compensating sound travels from the left speaker S(L) along the primary path Ll to the left ear, shortly before a corresponding right main sound is emitted from the right speaker S(R) and travels the secondary path Rl to the left ear Le. The compensating sound increment traveling the path of Ll and the right primary sound emanating from the right speaker Ls and traveling component path Rl substantially cancel each other out at the left ear Le.

From the above description, it can be readily appreciated that the sound emanating from the left speaker S(L) is heard essentially by the left ear Le only, while the sound emanating from the right speaker Rs is heard essentially only by the right ear Re. Without the benefit of the analysis accompanying the present invention, it is believed that the initial reaction of a person first viewing the mode of operation of the present invention would come to the conclusion that the present invention is destroying some of the stereophonic effect obtained by the two speakers. In other words, one could argue that since a single sound emanating from the left speaker Ls would reach only the left ear Le and not the right ear Re, the left and right ears could not make the differentiation in intensity and phase shift of the same sound traveling different paths to the two ears, and thus lose a valuable sensation of direction of source, which is part of the stereophonic effect. That initial reaction would have some element of truth in that the present invention does in a sense eliminate or at least diminish some of the traditional functional features of stereophonic sound. However, that analysis is incomplete since it does not take into consideration the nature of sounds produced by a stereophonic recording.

To turn our attention briefly back to the discussion under the heading "Theory of the Present Invention", consideration was given to the effect of eliminating sound which travels along the two secondary paths Lr and Rl. This was discussed with reference to reproducing the sounds that are recorded in a stereophonic system such as that shown in FIG. 3. A review of that discussion indicates that the sounds which are recorded with a substantial time delay (such as those emanating from the instrument 12*f* of FIG. 3) produce a distinctly different impression to the hearer when the sound along paths Lr and Rl are substantially eliminated. Some of the sounds seem to move out of the transmitting area of the two speakers to in a sense "surround" the hearer. Other sounds appear to originate from the transmitting area between the speakers. Yet other sounds give an intermediate impression of being "somewhere in between". Since this was discussed in more detail in the previous section entitled "Theory of the Present Invention", those remarks will not be repeated herein.

To apply this theory to the actual operation of the present invention, there is not in the present invention a total elimination of the sounds traveling along the secondary paths Rl and Lr. For example, consider again the signal increment which enters the left input terminal L(IN). This left signal increment results in an earlier main left sound emitted from the left speaker S(L), and a delayed compensating signal being emitted from the right speaker S(R). The compensating sound traveling the path Rr has a cancelling function. However, the compensating sound traveling the secondary path Rl to the left ear is not cancelled out. However, since the compensating sound from the right speaker S(R) is not only delayed relative to the corresponding main sound from the left speaker S(L), but also travels a longer secondary path Rl, the corresponding compensating from sound speaker S(R) reaches the left ear Le substantially later than the main sound traveling the path Ll. It has been found that this does not cause any significant degradation of the main sound component.

(e) Operation of the Invention Relative to Head Location and Angle

It was indicated earlier herein that the present invention can operate effectively even in circumstances where the person rotates his head in one direction or the other, or shifts his head laterally to a moderate extent. To explain this particular facet of the present invention, references is made to FIG. 6. In FIG. 6 the right and left speakers S(L) and S(R), respectively and the listening location are indicated schematically. As described previously, there is the base axis on which the two speakers S(L) and S(R) are located, and the longitudinal axis, which is perpendicular to the base axis and bisects the base axis. Additionally, there are right and left listening axes extending from the listening location to the right and left speakers S(R) and S(L) respectively. The right listening axis makes a right listening angle with the longitudinal axis, and in a like manner the left listening axis makes a left listening angle with the longitudinal axis. The left and right ears of the listener are indicated at Le and Re respectively, and the "ear spacing distance" is also indicated. For the purposes of this analysis, the ear spacing distance shall be presumed to be 7 inches.

Reference is now made to FIG. 7 which shows the listening location and the right and left ear Re and Le on an enlarged scale. In addition to showing the longitudinal axis, the right and left listening axes, and the right and left listening angles, also shown are the primary and secondary sound path components, indicated at Rr, Rl, Lr and Ll. Since the two speakers are generally spaced from the listening location at a large distance, relative to the spacing distance of the two ears Re and Le, for purposes of the present analysis, the left primary and secondary paths Ll and Lr can be considered to be parallel to one another, and the primary and secondary right paths Rr and Rl can also be considered to be parallel to one another.

In the following analysis, the term "time delay distance" will be used to denote an increment of distance over which sound will travel during a predetermined delay period. Thus, with sound traveling approximately 1080 feet per second (depending upon the ambient temperature), for a time delay of 100 microseconds, the time delay distance would be approximately 1.3 inches.

With a person's head positioned exactly at the listening location, and with the person facing parallel to the longitudinal axis, to obtain ideal signal cancellation in the present invention, there should be a time delay distance equal to a value obtained by multiplying the sine of the listening angle times the ear spacing distance. This ideal time delay distance is illustrated graphically at "x" in FIG. 7. On the assumption that the two speakers would be placed so that the two listening angles would be between 30° to 45°, the sine value would be between 0.5 and 0.707. On the assumption that the ear spacing distances between 6 and 8 inches, the range of the ideal time delay distance would be between 3 to 5½ or 6 inches. To translate this into an actual time value, the ideal time delay would then be in the range of between 230 microseconds and 460 microseconds.

Let us first give consideration to movement of the person's head forwardly and rearwardly about the longitudinal axis. Since the speakers S(L) and S(R) are generally placed a substantial distance from the listener, relative to the ear spacing distance, it becomes readily apparent that limited forward and rearward movement of the person's head (up to several feet) would have very little change in the listening angle. Accordingly, there would be very little change in the value of the ideal time delay distance. Thus, the fore and aft movement of the person's head would have substantially little effect on the present invention.

Let it now be assumed that the hearer rotates his head to the extent that the hearer is facing directly along the right listening axis toward the right speaker. The location of the left and right ears in this position are indicated at Le' and Re'. The precise point relative to the person's ears about which the turning takes place will vary moderately from person to person, but in general it is reasonable to assume that this point of turning takes place at a point directly between the person's ears Le and Re. Thus, with further reference to FIG. 7, it can be seen that the left ear Le has moved closer to the right speaker by a distance "y" which is equal to one-half the ideal time delay distance "x". Also, the left ear Le has moved closer to the left speaker S(L) by a distance of "z" which is only moderately less than the distance "y". Further analysis indicates that when the ear Le moves from its initial position to the turned position Le', the left ear Le has in effect moved laterally by a increment of distance indicated at "m" in FIG. 7. With the ear in the position Le', to obtain ideal cancellation, the change in the ideal time delay distance should be equal to twice the value "m" times the sine of the listening angle.

From the above analysis, it becomes apparent why the angular movement of the person's head about the listening location has little degrading effect in the operation of the present invention. In effect, an angular movement of, for example, up to 30°, causes a relatively greater forward movement and a relatively small lateral movement. As indicated previously, the system of the present invention is relatively insensitive to forward and rearward movement of the person's head about the listening location. Thus, the only effect really to be considered with regard to angular movement of the person's head is the limited lateral movement toward or away from the longitudinal axis which would actually change the time delay distance.

Consideration is now given to the effect that lateral movement (i.e. movement perpendicular to the longitudinal axis) would have on the time delay distance. Reference is made to FIG. 8, which is a representation quite similar to FIG. 7, where the person's right and left ears Re and Le are shown at the listening location. Let it be assumed that the person moves his head to the right, with no lateral movement and no rotational movement. Four locations are shown for each ear. The left ear is shown at its ideal location, and then moved to the right by three increments, each increment being equal to one-quarter of the ear spacing distance. In like manner, the right ear is shown at its original position Re and also at three spaced locations to the right, each spacing being equal to one-quarter of the ear spacing distance.

With the left and right ears at the ideal position, at Le and Re, the ideal time delay distance remains at the value of the ear spacing distance times the sine of the listening angle. When the left ear has moved to the right a distance equal to one-quarter of the ear spacing distance (i.e. to the location Le(a)), the left ear simultaneously moves further from the left speaker S(L) and closer to the right speaker S(R). Each increment of change is equal to the distance increment of lateral travel times the sine of the listening angle. The effect of these two increments is cumulative, so that the net change in the ideal time delay distance relative to the left ear is equal to two times the lateral movement of the left ear times the sine of the listening angle. By the time the left ear reaches the location of the longitudinal axis (at Le(b)), the ear is equally distant from both speakers. Thus, the time delay distance to obtain sound cancellation has been reduced to zero. Further movement of the left ear to the location Le(c), indicates that there is actually a negative time delay distance to obtain cancellation. In other words, the cancelling sound from the right speaker S(R) would have to be emitted before the main left signal was emitted from the left speaker S(L).

With regard to the right ear Re, it becomes apparent that for each incremental movement to the right, the ideal time delay distance would increase at the same rate that it would decrease for the left ear. Thus, at locations Re(a), Re(b) and Re(c), the time delay distance would be, respectively, one and one-quarter of the ideal time delay distance, one and one-half of the ideal time delay distance, and one and three-quarters of the ideal time delay distance.

In the present invention, the compensating signal is transmitted over a plurality of spaced time delay increments. The selection of these time delay increments was obtained partly analytically and partly empirically. The time delay distance increments for the various time delay increments are given below:

| | time delay increment (microseconds) | time delay distance increments (inches) |
|---|---|---|
| t1 | 110 | 1.53 |
| t2 | 118 | 2.34 |
| t3 | 370 | 4.81 |
| t4 | 690 | 8.97 |

With further reference to FIG. 8, let it be assumed that the ear spacing distance is 7 inches, and that each of the listening angles if 45°. Thus, the ideal time delay distance would be approximately five inches. With the person's head being centrally located on the longitudinal axis, it can be seen that the compensating sound at the time delay increment t3 (which has a precise time delay distance of 4.81 inches) would be the primary cancelling sound. As the person moves his head laterally to the right, for the left ear, which is moving closer to the longitudinal axis and thus requires a shorter time delay increment, the cancelling sound having time delay increments of first t2, and then t1, would come into play. However, for the right ear, the effect of the cancelling sound having a time delay increment of t3 would still be effective as the right ear moves further from the longitudinal axis, but would be diminished somewhat. Thus, it can be appreciated that, with further reference to FIG. 8, when the person reaches the position indicated at Le(a) and Re(a), the cancellation phenomenon is still effective.

With regard to the sensitivity of the compensating signal to position, it should be kept in mind that a a sound having a fundamental frequency of "middle C" (i.e. 264 cycles per second) has a fundamental wave length of nearly four feet. Even for a sound of 1,000 cycles per second, the wave length is about a foot. Thus, there can still be substantial sound cancellation even where the departures from the ideal time delay distance are in the order of several inches or more.

Therefore, even when the person reaches the position of the ears being at Le(b) and Re(b), there is still a substantial cancelling effect, since the cancelling sound waves are reasonably tolerant to moderate phase shifts. When the person's head is moved yet further to the right, it becomes apparent that the cancellation phenomenon at the left ear Le is further diminished, and there is yet a fair amount of the cancellation phenomenon at the right ear, due to the compensating sounds that have time delay increments to t3 and t4. For example, the cancellation sound with the time increment t4 would be fully effective when the person has moved his head nearly 5½ inches from the longitudinal axis laterally to the right.

When the person moves his head a substantial distance to one side or the other, the ear that is further from the longitudinal axis still obtains some of the dimensional effect, but at a reduced level. However, it is believed that the other ear, which is moved across the longitudinal axis has lost a substantially greater amount of the dimensionalized effect. The psychological result of this is that the person will tend to move his head back in the direction of the ear which has lost more of the dimensionalized effect. In other words, the person will tend to move his head back toward the longitudinal axis so that the ear nearest to the longitudinal axis will move back across the longitudinal axis and obtain more of the dimensionalized effect.

With regard to the various frequency equalizers modifying the intensity of the sound as a function of frequency (as shown in FIGS. 5 and 5A), the values which were finally selected resulted from an empirical analysis of trying various combinations of sound intensities. The subjective effect produced on the listener by the frequency/intensity pattern disclosed herein is believed by the inventor to be quite satisfactory. However, variations could be made to modify the effect to suit the individual listener.

The approximate range for time delay increments can be varied, and the amount of variation will depend to some extent on the relative intensity of the main signal component and the compensating signal components. In general, the ranges are believed to be approximately as follows:

| time delay increment | time delay distance range (inches) |
|---|---|
| t1 | 1–3 |
| t2 | 2–4 |
| t3 | 3–7 |
| t4 | 6–12 |

(f) Reflected Sound

It was indicated earlier herein that one of the problems of the prior art systems known to the applicant was that reflected sound caused substantial deterioration of the dimensional effect. In the present invention it is noted that each combined signal emitted from the summing junctions C(L) and C(R) is directed back through a time delay device D(L) or D(R) back to the input source L(IN) or R(IN). The amount of time delay is 800 microseconds, which is moderately longer than the longest time delay increment of the time delay frequency equalizers b4(RL) and b4(LR). The effect of this is to direct the total signal (the main signal plus the compensating signal) back through the system. In addition, the total signal is not only directed back through the same summing junction, but is also directed through the crossover circuit to the opposite summing junction.

One of the primary reasons for this is that the reflected sounds should also be compensated for to some extent. In many circumstances, the stereo speakers are placed on the floor, close to the floor, or possibly in a corner. Accordingly, it is expected that sound will be reflected off the floor and/or walls and be directed to the hearer at a time delay in the order of possibly one millisecond or so. It is believed that this feedback mechanism, D(L) and D(R), being fed back through the system in a delayed, at least partially compensate for this reflected sound.

(g) Conclusion

It is to be understood, of course, that the above analysis is not intended to be thoroughly exhaustive of the matter. As indicated previously, regardless of the validity or accuracy of this analysis, it has been found that the apparatus does produce this dimensionalized effect and shows a reasonable tolerance to angular and positional deviations of the person's head location.

What is claimed is:

1. A dimensionalized audio signal producing apparatus adapted to utilize stereo signals which are characterized in that said signals are non-binaural signals having either a phase shift relationship between corresponding signal components, which phase shift relationship has a time delay distance greater than a time delay distance of a binaural phase shift for an ear spacing distance of a listener, or an amplitude difference greater than binaural amplitude differences of corresponding signal components, and adapted to be used in conjunction with a pair of speakers, where the following conditions exist:

a. there is a playing area, b. in said playing area there is a forward transmitting area where there are right and left speakers positioned at right and left speaker locations on a base axis and spaced from one another on said base axis by a speaker spacing distance, c. there is a longitudinal axis positioned equally distant from said speaker locations and perpendicular to said base axis, d. there is a listening area at the center of which is a listening location positioned on said longitudinal axis rearwardly of said base axis, e. there is a right listening axis extending from said listening location to said right speaker location at a right listening angle to said longitudinal axis, f. there is a left listening axis extending from said listening location to said left speaker location at a left listening angle to said longitudinal axis, g. there are right and left ear locations corresponding to right and left ear positions of a person's head which could be located at said listening location and facing forwardly along said longitudinal axis to said base axis, said right and left ear locations being spaced from one another by an ear spacing distance, said apparatus comprising:

a. left input means to receive a left stereo signal, b. right input means to receive a right stereo signal, c. left signal output means to produce an audio signal for a left speaker, d. right signal output means to produce an audio signal for a right speaker, e. left main transmitting means to transmit a left main signal component, corresponding and similar to the left stereo signal, to the left signal output means, f. right main transmitting means to transmit a right main signal component, corresponding to and similar to the right stereo signal, to the right signal output means, g. left to right compensating means adapted to receive said left stereo signal to produce an inverted and delayed left to right compensating signal corresponding to said left stereo signal, and to transmit said left to right compensating signal to said right signal output means, h. right to left compensating means adapted to receive said right stereo signal to produce an inverted and delayed right to left compensating signal corresponding to said right stereo signal, and to transmit said right to left compensating signal to said right signal output means, i. said two compensating signals each being delayed relative to corresponding main signal components by a time delay period within a predetermined time delay range, the means of said apparatus being constructed, arranged and related to one another in a manner that said left signal output means produces a left audio signal comprising said left main signal component and said right to left compensating signal, and said right signal output means produces a right audio signal comprising said right main signal component and said left to right compensating signal, so that when said left audio signal drives the left speaker and said right audio signal drives the right speaker, the following occurs a. there is a left audio output having a main left sound component and a right to left compensating sound component, said left audio output having a primary path component from said left speaker to said left ear location, and a secondary path component from said left speaker to said right ear location, b. there is a right audio output having a main right sound component and a left to right compensating sound component, said right audio output having a primary path component from said right speaker to said right ear location, and a secondary path component from said right speaker location to said left ear location, c. the main left sound component reaches the left ear location without being cancelled to a substantial amount, d. the right main sound component reaches the right ear location without being cancelled to a substantial amount, e. the main left sound component travelling its secondary path to said right ear location is cancelled to a substantial amount by the left to right compensating sound component travelling on the primary path from said right speaker to said right ear location, f. the main right sound component travelling on the secondary path from said right speaker to said left ear location is cancelled to a substantial amount by the right to left compensating sound component travelling from said left speaker along the left primary path to the left ear location, whereby a person positioned so that the person's head is at the listening location facing along the longitudinal axis toward the transmitting area hears a dimensionalized sound with apparent sound sources being outside of the transmitting area of the two speakers.

2. The apparatus as recited in claim 1, wherein there is for each time delay period a time delay distance, which is that distance that sound travels during the corresponding time delay period, said apparatus being further characterized in that the time delay range for the compensating signals has a smaller time delay limit with a corresponding smaller time delay distance limit, and a larger time delay limit having a corresponding larger time delay distance limit, the smaller and larger time delay distances encompassing a range which includes an optimum time delay distance equal to a value obtained by multiplying the sine of either listening angle times the ear spacing distance.

3. The apparatus as recited in claim 2, wherein each of said compensating signals has a plurality of compensating signal components, each having a different corresponding time delay distance component, at least one of said time delay distance components being smaller than said optimum time delay distance.

4. The apparatus as recited in claim 2, wherein each of said compensating signals has a plurality of compensating signal components, each having a different corresponding time delay distance component, at least one of said time delay distance components being greater than said optimum time delay distance.

5. The apparatus as recited in claim 2, wherein each of said compensating signals has a plurality of compensating signal components, each having a different corresponding time delay distance component, at least one of said time delay distance components being greater than said optimum time delay distance, and at least one other of said time delay distance components being smaller than the optimum time delay distance.

6. The apparatus as recited in claim 5, wherein at least some of said compensating signal components have decibel values lower than a decibel value of its corresponding main sound component.

7. The apparatus as recited in claim 6, wherein at least one of said compensating signal components has a decibel value which varies with frequency, with lower frequencies of that compensating signal component having a higher decibel level than at higher frequencies of that compensating signal component.

8. The apparatus as recited in claim 1, wherein said left and right main transmitting means comprises frequency equalizer means, each of said frequency equalizer means producing its main signal component having a higher decibel level for lower frequencies and a lower decibel level for higher frequencies.

9. The apparatus as recited in claim 1, wherein there are left and right feedback means to receive respective left and right feedback signals from the left and right signal output means respectively, and transmit feedback signals to, respectively, the left and right input means, said feedback signals being delayed by a time period at least as great as a time delay period of the compensating signals.

10. The apparatus as recited in claim 9, wherein the time delay period for the feedback signals is greater than the time delay periods of the compensating signals.

11. The apparatus as recited in claim 1, wherein there is for each time delay period a time delay distance, which is that distance that sound travels during the corresponding time delay period, there is further an optimum time delay distance equal to a value obtained by multiplying the sine of either listening angle times the ear spacing distance, each of said compensating signals having a plurality of compensating signal components, each having a different corresponding time delay distance component, at least some of said compensating signal components having a time delay distance between one and twelve inches.

12. The apparatus as recited in claim 11, wherein at least one of said compensating signal components has a time delay distance between one to three inches.

13. The apparatus as recited in claim 11, wherein at least one of said compensating signal components has a time delay distance between two to four inches.

14. The apparatus as recited in claim 11, wherein at least one of said compensating signal components has a time delay distance between three to seven inches.

15. The apparatus as recited in claim 11, wherein at least one of said compensating signal components has a time delay distance between six to twelve inches.

16. The apparatus as recited in claim 11, wherein there is for each compensating signal at least four compensating sound components, namely a first compensating sound component having a time delay distance between one to three inches, a second compensating signal component having a time delay distance between two to four inches, a third compensating signal component having a time delay distance between three to seven inches, and a fourth compensating signal component having a time delay distance range between six to twelve inches.

17. The apparatus as recited in claim 1, wherein said right and left main transmitting means each comprises frequency equalizer means which produces the related main signal component in a manner that certain frequency portions of the related main signal component are varied as a function of frequency.

18. The apparatus as recited in claim 17, wherein the main signal components are modified in a manner that lower frequency portions are of relatively greater intensity than higher frequency portions.

19. The apparatus as recited in claim 1, wherein each of said left to right compensating means comprises inverting means to invert a related stereo signal, and a plurality of frequency equalizer means to delay an inverted signal from the inverter means and produce a plurality of compensating signal components having different time delay periods.

20. The apparatus as recited in claim 1, wherein a. said right and left main transmitting means each comprises frequency equalizer means which produces the related main signal component in a manner that certain frequency portions of the related main signal component are varied as a function of frequency.

b. the main signal components are modified in a manner that lower frequency portions are of relatively greater intensity than higher frequency portions.

c. each of said left to right compensating means comprises inverting means to invert a related stereo signal, and a plurality of frequency equalizer means to delay an inverted signal from the inverter means and produce a plurality of compensating signal components having different time delay periods.

21. The apparatus as recited in claim 17, wherein there is for each compensating means switch means to control intensity of the stereo signal received, so as to increase or decrease compensating effect of the related compensating means.

22. The apparatus as recited in claim 1, wherein:

a. said right and left main transmitting means each comprises frequency equalizer means which produces the related main signal component in a manner that certain frequency portions of the related main signal component are varied as a function of frequency, b. each of said left to right compensating means comprises inverting means to invert a related stereo signal, and a plurality of frequency equalizer means to delay an inverted signal from the inverter means and produce a plurality of compensating signal components having different time delay periods, c. at least some of said compensating signal components having a time delay distance between one and twelve inches.

23. The apparatus as recited in claim 22, wherein at least one of said compensating signal components has a time delay distance between one to three inches.

24. The apparatus as recited in claim 22, wherein at least one of said compensating signal components has a time delay distance between two to four inches.

25. The apparatus as recited in claim 22, wherein at least one of said compensating signal components has a time delay distance between three to seven inches.

26. The apparatus as recited in claim 22, wherein at least one of said compensating signal components has a time delay distance between six to twelve inches.

27. The apparatus as recited in claim 22, wherein there is for each compensating signal at least four compensating sound components, namely a first compensating sound components having a time delay distance between one to three inches, a second compensating signal component having a time delay distance between two to four inches, a third compensating signal component having a time delay distance between three to seven inches, and a fourth compensating signal component having a time delay distance range between six to twelve inches.

28. The apparatus as recited in claim 27, wherein:

a. the main signal components are modified in a manner that lower frequency portions are of relatively greater intensity than higher frequency portions,
b. at least some of said compensating signal components have decibel values lower than a decibel value of its corresponding main sound component,
c. at least one of said compensating signal components has a decibel value which varies with frequency, with lower frequencies of that compensating signal component having a higher decibel level than at higher frequencies of that compensating signal component.

29. The apparatus as recited in claim 28, wherein there are left and right feedback means to receive respective left and right feedback signals from the left and right signal output means, respectively, and transmit feedback signals to, respectively, the left and right imput means, said feedback signals being delayed by a time period at least as great as a time delay period of the compensating signals.

30. A method of producing a dimensionalized audio signal adapted to utilize stereo signals which are characterized in that said signals are non-binaural signals having either a phase shift relationship between corresponding signal components, which phase shift relationship has a time delay distance greater than a time delay distance of a binaural phase shift for an ear spacing distance of a listener, or an amplitude difference greater than binaural amplitude differences of corresponding signal components, and adapted to be used in conjunction with a pair of speakers, where the following conditions exist:

a. there is a playing area,
b. in said playing area there is a forward transmitting area where there are right and left speakers positioned at right and left speaker locations on a base axis and spaced from one another on said base axis by a speaker spacing distance,
c. there is a longitudinal axis positioned equally distant from said speaker locations and perpendicular to said base axis,
d. there is a listening area at the center of which is a listening location positioned on said longitudinal axis rearwardly of said base axis,
e. there is a right listening axis extending from said listening location to said right speaker location at a right listening angle to said longitudinal axis,
f. there is a left listening axis extending from said listening location to said left speaker location at a left listening angle to said longitudinal axis,
g. there are right and left ear locations corresponding to right and left ear positions of a person's head which could be located at said listening location and facing forwardly along said longitudinal axis to said base axis, said right and left ear locations being spaced from one another by an ear spacing distance, said method comprising:

a. directing a left stereo signal to left input means,
b. directing a right stereo signal to right input means,
c. transmitting a left main signal component, corresponding and similar to the left stereo signal, to a left signal output means,
d. transmitting a right main signal component, corresponding to and similar to the right stereo signal, to a right signal output means,
e. producing from said left stereo signal an inverted and delayed left to right compensating signal, corresponding to said left stereo signal, and transmitting said left to right compensating signal to said right signal output means,
f. producing from said right stereo signal an inverted and delayed right to left compensating signal, corresponding to said right stereo signal, and transmitting said right to left compensating signal to said left signal output means,
g. said two compensating signals each being delayed relative to corresponding main signal components by a time delay period within a predetermined time delay range, the steps of said method being so arranged and related to one another in a manner that said left signal output means produces a left audio signal comprising said left main signal component and said right to left compensating signal, and said right signal output means produces a right audio signal comprising said right main signal component and said left to right compensating signal, so that when said left audio signal drives the left speaker and said right audio signal drives the right speaker, the following occurs a. there is a left audio output having a main left sound component and a right to left compensating sound component, said left audio output having a primary path component from said left speaker to said left ear location, and a secondary path component from said left speaker to said right ear location,
b. there is a right audio output having a main right sound component and a left to right compensating component, said right audio output having a primary path component from said right speaker to said right ear location, and a secondary path component from said right speaker location to said left ear location,
c. the main left sound component reaches the left ear without being cancelled to a substantial amount,
d. the right main sound component reaches the right ear location without being cancelled to a substantial amount,
e. the main left sound component travelling its secondary path to said right ear location is cancelled to a substantial amount by the left to right compensating sound component travelling on the primary path from said right speaker to said right ear location,
f. the main right sound component travelling on the secondary path from said right speaker to said left ear location is cancelled to a substantial amount by the right to left compensating sound component travelling from said left speaker along the left primary path to the left ear location, whereby a person positioned so that the person's head is at the listening location facing along the longitudinal axis toward the transmitting area hears a dimensionalized sound with apparent sound sources being outside of the transmitting area of the two speakers.

31. The method as recited in claim 30, wherein there is for each time delay period a time delay distance, which is that distance that sound travels during the corresponding time delay period, said method being further characterized in that the time delay range for the compensating signals has a smaller time delay limit with a corresponding smaller time delay distance limit, and a larger time delay limit having a corresponding larger time delay distance limit, the smaller and larger time delay distances encompassing a range which includes an optimum time delay distance equal to a value obtained by multiplying the sine of either listening angle times the ear spacing distance.

32. The method as recited in claim 31, wherein each of said compensating signals has a plurality of compensating signal components, each having a different corresponding time delay distance component, at least one of said time delay distance components being smaller than said optimum time delay distance.

33. The method as recited in claim 31, wherein each of said compensating signals has a plurality of compensating signal components, each having a different corresponding time delay distance component, at least one of said time delay distance components being greater than said optimum time delay distance.

34. The method as recited in claim 31, wherein each of said compensating signals has a plurality of compensating signal components, each having a different corresponding time delay distance component, at least one of said time delay distance components being greater than said optimum time delay distance, and at least one other of said time delay distance components being smaller than the optimum time delay distance.

35. The method as recited in claim 34, wherein at least some of said compensating signal components have decibel values lower than a decibel value of its corresponding main sound component.

36. The method as recited in claim 35, wherein at least one of said compensating signal components has a decibel value which varies with frequency, with lower frequencies of that compensating signal component having a higher decibel level than at higher frequencies of that compensating signal component.

37. The method as recited in claim 30, further comprising producing main signal components having a higher decibel lever for lower frequencies and a lower decibel level for higher frequencies.

38. The method as recited in claim 30, further comprising producing left and right feedback signals from the left and right signal output means respectively, and transmitting feedback signals to, respectively, the left and right input means, said feedback signals being delayed by a time period at least as great as a time delay period of the compensating signals.

39. The method as recited in claim 38, wherein the time delay period for the feedback signals is greater than the time delay periods of the compensating signals.

40. The method as recited in claim 30, wherein there is for each time delay period a time delay distance, which is that distance that sound travels during the corresponding time delay period, there is further an optimum time delay distance equal to a value obtained by multiplying the sine of either listening angle times the ear spacing distance, each of said compensating signals having a plurality of compensating signal components, each having a different corresponding time delay distance component, at least some of said compensating signal components having a time delay distance between one and twelve inches.

41. The method as recited in claim 40, wherein at least one of said compensating signal components has a time delay distance between one to three inches.

42. The method as recited in claim 40, wherein at least one of said compensating signal components has a time delay distance between two to four inches.

43. The method as recited in claim 40, wherein at least one of said compensating signal components has a time delay distance between three to seven inches.

44. The method as recited in claim 40, wherein at least one of said compensating signal components has a time delay distance between six to twelve inches.

45. The method as recited in claim 40, wherein there is for each compensating signal at least four compensating sound components, namely a first compensating sound component having a time delay distance between one to three inches, a second compensating signal component having a time delay distance between two to four inches, a third compensating signal component having a time delay distance between three to seven inches, and a fourth compensating signal component having a time delay distance range between six to twelve inches.

46. The method as recited in claim 30, wherein the signal components are modified in a manner that certain frequency portions of the related main signal component are varied as a function of frequency.

47. The method as recited in claim 46, wherein the main signal components are modified in a manner that lower frequency portions are of relatively greater intensity than higher frequency portions.

48. The method as recited in claim 30, comprising:

a. producing main signal component in a manner that certain frequency portions of the related main signal component are varied as a function of frequency b. modifying the main signal components in a manner that lower frequency portions are of relatively greater intensity than higher frequency portions.

49. A dimensionalized audio signal producing apparatus adapted to be used to produce dimensionalized sound from right and left stereophonic signals characterized in that said signals are non-binaural signals having either a phase shift relationship between corresponding signal components, which phase shift relationship has a time delay distance greater than a time delay distance of a binaural phase shift for an ear spacing distance of a listener, or an amplitude difference greater than binaural amplitude differences of corresponding signal components, and where the following conditions exist:

a. there is a forward playing area where there are right and left speaker locations, b. there is a listening area with a listening location positioned rearwardly of said playing area, c. there are right and left ear locations corresponding to right and left ear positions of a person's head which could be located at said listening location and facing forwardly toward said playing area, said apparatus comprising:

a. left input means to receive a left stereo signal, b. right input means to receive a right stereo signal, c. left signal output means to produce an audio signal for left speaker means at said left speaker location, d. right signal output means to produce an audio signal for right speaker means at said right speaker location, e. left main transmitting means to transmit a left main signal component, corresponding and similar to the left stereo signal, to the left signal output means to produce a left main audio component, f. right main transmitting means to transmit a right main signal component, corresponding to and similar to the right stereo signal, to the right signal output means to produce a right main audio component, g. left to right compensating means adapted to receive said left stereo signal to produce an inverted left to right compensating signal corresponding to said left stereo signal, and to transmit said left to right compensating signal to said right signal output means to produce a left to right compensating audio component, h. right to left compensating means adatped to receive said right stereo signal to produce an inverted right to left compensating signal corresponding to said right stereo signal, and to transmit said right to left compensating signal to said left signal output means to produce a right to left compensating audio component, i. said two compensating audio components each having a time delay distance relative to corresponding main audio components within a predetermined time delay range, the means of said apparatus being constructed, arranged and related to one another in a manner that:

a. said left main audio component has a primary path component from said left speaker means to said left ear location, and a secondary path component from said left speaker means to said right ear location, b. said right main audio component has a primary path component from said right speaker means to said right ear location, and a secondary path component from said right speaker means to said left ear location, c. the main left audio component reaches the left ear location without being cancelled a substantial amount, d. the right main audio component reaches the right ear location without being cancelled a substantial amount, e. the main left audio component travelling its secondary path to said right ear location is cancelled to a substantial amount by the left to right compensating audio component travelling from said right speaker means to said right ear location, f. the main right audio component travelling on its secondary path to said left ear location is cancelled to a substantial amount by the right to left compensating audio component travelling from said left speaker means to the left ear location, whereby a person positioned so that the person's head is at the listening location facing toward the transmitting area hears a dimensionalized sound with apparent sound sources being outside of the playing area of the two speaker means.

50. The apparatus as recited in claim 49, wherein each of said compensating signals has a plurality of compensating signal components, each having a different corresponding time delay distance component, at least one of said time delay distance components being smaller than a time delay distance which provides optimum cancellation at said ear locations.

51. The apparatus as recited in claim 49, wherein each of said compensating signals has a plurality of compensating signal components, each having a different corresponding time delay distance component, at least one of said time delay distance components being greater than a time delay distance which provides optimum cancellation at said ear location.

52. The apparatus as recited in claim 49, wherein each of said compensating signals has a plurality of compensating signal components, each having a different corresponding time delay distance component, at least one of said time delay distance components being greater than an optimum time delay distance, and at least one other of said time delay distance components being smaller than the optimum time delay distance, said optimum time delay distance providing optimum cancellation at said ear locations.

53. The apparatus as recited in claim 52, wherein at least some of said compensating signal components have decibel values lower than a decibel value of its corresponding main signal component.

54. The apparatus as recited in claim 53, wherein at least one of said compensating signal components has a decibel value which varies with frequency, with lower frequencies of that compensating signal component having a higher decibel level than at higher frequencies of that compensating signal component.

55. The apparatus as recited in claim 49, further comprising frequency equalizer means, said frequency equalizer means producing main signal components having a higher decibel level for lower frequencies and a lower decibel level for higher frequencies.

56. The apparatus as recited in claim 49, wherein each of said compensating means comprises inverting means to invert a related stereo signal, and a plurality of frequency equalizer means to delay an inverted signal from the inverting means and produce a plurality of compensating signal components having different time delay periods.

57. An audio system adapted to produce dimensionalized sound from right and left stereo signals which are characterized in that said signals are non-binaural signals having either a phase shift relationship between corresponding signal components, which phase shift relationship has a time delay distance greater than a time delay distance of a binaural phase shift for an ear spacing distance of a listener, or an amplitude difference greater than binaural amplitude differences of corresponding signal components, and where the following conditions exist:

a. there is a forward playing area where there are right and left speaker locations, b. there is a listening area with a listening location positioned rearwardly of said playing area, c. there are right and left ear locations corresponding to right and left ear positions of a person's head which could be located at said listening location and facing forwardly toward said playing area said system comprising:

a. left main transmitting means to receive said left stereo signal and provide an left main stereo output signal, b. a right main transmitting means to receive said right stereo signal and provide a right main stereo output signal, c. a left to right compensating means to receive said left stereo signal to produce an inverted left to right compensating signal corresponding to said left stereo signal, d. a right to left compensating means to receive said right stereo signal to produce an inverted right to left compensating signal corresponding to said right stereo signal, e. left audio output means to receive said left main stereo output signal and said right to left compensating signal to produce:

1. a left main audio component corresponding to said left main stereo output signal, 2. a right to left compensating audio component corresonding to said right to left compensating signal, f. right audio output means to receive said right main stereo output signal and said left to right compensating signal to produce:

1. a right main audio component corresponding to said right main stereo output signal,
2. a left to right compensating audio component corresponding to said left to right compensating signal, g. said compensating means and said audio output means being arranged such that, each of said two compensating audio components has a predetermined time delay distance relative to its corresponding main audio component within a predetermined time delay range, the means of said system being constructed, arranged and related to one another in a manner that:

a. said left main audio component has a primary path component from said left speaker location to said left ear location, and a secondary path component from said left speaker location to said right ear location,
b. said right main audio component has a primary path component from said right speaker location to said right ear location, and a secondary path component from said right speaker location to said left ear location,
c. the main left audio component reaches the left ear location without being cancelled a substantial amount,
d. the right main audio component reaches the right ear location without being cancelled a substantial amount,
e. the main left audio component travelling its secondary path to said right ear location is cancelled to a substantial amount by the left to right compensating sound component travelling from said right audio output means to said right ear location,
f. the main right sound component travelling on the secondary path to said left ear location is cancelled to a substantial amount by the right to left compensating sound component travelling from said left audio output means to the left ear location, whereby a person positioned so that the person's head is at the listening location facing toward the transmitting area hears a dimensionalized sound with apparent sound sources being outside of the transmitting area of the two speaker locations.

58. The apparatus as recited in claim 57, wherein said compensating signals are so arranged that each compensating audio component has a plurality of compensating audio component portions, each having a different corresponding time delay distance component, at least one of said time delay distance components being smaller than a time delay distance which provides optimum cancellation at said ear locations.

59. The apparatus as recited in claim 57, wherein said compensating signals are so arranged that each compensating audio component has a plurality of compensating audio component portions, each having a different corresponding time delay distance component, at least one of said time delay distance components being greater than a time delay distance which provides optimum cancellation at said ear location.

60. The apparatus as recited in claim 57, wherein said compensating signals are so arranged that each compensating audio component has a plurality of compensating audio component portions, each having a different corresponding time delay distance component, at least one of said time delay distance components being greater than an optimum time delay distance, and at least one other of said time delay distance components being smaller than the optimum time delay distance, said optimum time delay distance providing optimum cancellation at said ear locations.

61. The apparatus as recited in claim 60, wherein at least some of said compensating audio component portions have decibel values lower than a decibel value of its corresponding main audio component.

62. The apparatus as recited in claim 61, wherein at least one of said compensating audio component portions has a decibel value which varies with frequency, with lower frequencies of that compensating audio component portion having a higher decibel level than at higher frequencies of that compensating signal component.

63. The apparatus as recited in claim 57, further comprising frequency equalizer means, said frequency equalizer means producing main audio components having a higher decibel level for lower frequencies and a lower decibel level for higher frequencies.

64. The apparatus as recited in claim 57, wherein each of said compensating means comprises inverting means to invert a related stereo signal, and a plurality of frequency equalizer means to delay an inverted signal from the inverter means and produce a plurality of compensating signal components having different time delay periods.

65. An audio system adapted to produce dimensionalized sound from right and left stereo signals which are characterized in that said signals are non-binaural signals having either a phase shift relationship between corresponding signal components, which phase shift relationship has a time delay distance greater than a time delay distance of a binaural phase shift for an ear spacing distance of a listener, or an amplitude difference greater than binaural amplitude differences of corresponding signal components, said system comprising:

a. left and right speaker means at right and left speaker locations, respectively, said speaker means arranged to transmit sounds to a listening location where there are right and left ear locations corresponding to right and left ear positions of a person's head which could be located at said listening location,
b. left main transmitting means to receive said left stereo signal and provide a left main stereo output signal for said left speaker means,
c. a right main transmitting means to receive said right stereo signal and provide a right main stereo output signal for said right speaker means,
d. a left to right compensating means to receive said left stereo signal to produce an inverted left to right compensating signal corresponding to said left stereo signal for said right speaker means,
e. a right to left compensating means to receive said right stereo signal to produce an inverted right to left compensating signal corresponding to said right stereo signal for said left speaker means,
f. said left speaker means adapted to receive said left main stereo output signal and said right to left compensating signal to produce:

1. a left main audio component corresponding to said left main stereo output signal, 2. a right to left compensating audio component corresponding to said right to left compensating signal, g. said right speaker means adapted to receive said right main stereo output signal and said left to right compensating signal to produce:

1. a right main audio component corresponding to said right main stereo output signal,
2. a left to right compensating audio component corresponding to said left to right compensating signal, h. said system being arranged such that each of said two compensating audio components has a predetermined time delay distance relative to its corresponding main audio component within a predetermined time delay range, the means of said system being constructed, arranged and related to one another in a manner that:

a. said left main audio component has a primary path component from said left speaker means to said left ear location, and a secondary path component from said left speaker means to said right ear location, b. said right main audio component has a primary path component from said right speaker means to said right ear location, and a secondary path component from said right speaker means to said left ear location, c. the main left audio component reaches the left ear location without being cancelled a substantial amount, d. the right main audio component reaches the right ear location without being cancelled a substantial amount, e. the main left audio component travelling its secondary path to said right ear location is cancelled to a substantial amount by the left to right compensating audio component travelling from said right speaker means to said right ear location, f. the main right sound component travelling on the secondary path to said left ear location is cancelled to a substantial amount by the right to left compensating audio component travelling from said left speaker means to the left ear location, whereby a person positioned so that the person's head is at the listening location hears a dimensionalized sound with apparent sound sources being outside of the two speaker locations.

66. The system as recited in claim 65, wherein said compensating signals are so arranged that each compensating audio component has a plurality of compensating audio component portions, each having a different corresponding time delay distance component, at least one of said time delay distance components being smaller than a time delay distance which provides optimum cancellation at said ear locations.

67. The system as recited in claim 65, wherein said compensating signals are so arranged that each compensating audio component has a plurality of compensating audio component portions, each having a different corresponding time delay distance component, at least one of said time delay distance components being greater than a time delay distance which provides optimum cancellation at ear location.

68. The apparatus as recited in claim 65, wherein said compensating signals are so arranged that each compensating audio component has a plurality of compensating audio component portions, each having a different corresponding time delay distance component, at least one of said time delay distance components being greater than an optimum time delay distance, and at least one other of said time delay distance components being smaller than the optimum time delay distance, said optimum time delay distance providing optimum cancellation at said ear locations.

69. The apparatus as recited in claim 68, wherein at least some of said compensating audio component portions have decibel values lower than a decibel value of its corresponding main audio component.

70. The apparatus as recited in claim 69, wherein at least one of said compensating audio component portions has a decibel value which varies with frequency, with lower frequencies of that compensating audio component portion having a higher decibel level than at higher frequencies of that compensating signal component.

71. The apparatus as recited in claim 65, further comprising frequency equalizer means, said frequency equalizer means producing main audio components having a higher decibel level for lower frequencies and a lower decibel level for higher frequencies.

72. The apparatus as recited in claim 65, wherein each of said compensating means comprises inverting means to invert a related stereo signal, and a plurality of frequency equalizer means to delay an inverted signal from the inverter means and produce a plurality of compensating signal components having different time delay periods.

73. A method to produce dimensionalized sound from right and left stereo signals which are characterized in that said signals are non-binaural signals having either a phase shift relationship between corresponding signal components, which phase shift relationship has a time delay distance greater than a time delay distance of a binaural phase shift for an ear spacing distance of a listener, or an amplitude difference greater than binaural amplitude differences of corresponding signal components, where the following conditions exist:

a. there is a forward playing area where there are right and left speaker locations, b. there is a listening area with a listening location positioned rearwardly of said playing area, c. there are right and left ear locations corresponding to right and left ear positions of a person's head which could be located at said listening location and facing forwardly toward said playing area said method comprising:

a. receiving said left stereo signal and providing a left main stereo output signal, b. receiving said right stereo signal and providing a right main stereo output signal, c. providing an inverted left to right compensating signal corresponding to said left stereo signal, d. providing an inverted right to left compensating signal corresponding to said right stereo signal, e. transmitting said left main stereo output signal and said right to left compensating signal to left audio output means to produce 1. a left main audio component corresponding to said left main stereo output signal,
2. a right to left compensating audio component corresponding to said right to left compensating signal, f. transmitting said right main stereo output signal and said left to right compensating signal to right audio output means to produce:

1. a right main audio component corresponding to said right main stereo output signal,
2. a left to right compensating audio component corresponding to said left to right compensating signal, g. each of said two compensating audio components having a predetermined time delay distance relative to its corresponding main audio component within a predetermined time delay range, with steps of said method being arranged and related to one another in a manner that:

a. said left main audio component has a primary path component from said left speaker location to said left ear location, and a secondary path component from said left speaker location to said right ear location,
b. said right main audio component has a primary path component from said right speaker location to said right ear location, and a secondary path component from said right speaker location to said left ear location,
c. the main left audio component reaches the left ear location without being cancelled a substantial amount,
d. the right main audio component reaches the right ear location without being cancelled a substantial amount,
e. the main left audio component travelling its secondary path to said right ear location is cancelled to a substantial amount by the left to right compensating audio component travelling from said right audio output means to said right ear location,
f. the main right audio component travelling on the secondary path to said left ear location is cancelled to a substantial amount by the right to left compensating audio component travelling from said left audio output means to the left ear location, whereby a person positioned so that the person's head is at the listening location facing toward the transmitting area hears a dimensionalized sound with apparent sound sources being outside of the playing area of the two speaker locations.

74. The method as recited in claim 73, wherein said compensating signals are so arranged that each compensating audio component has a plurality of compensating audio component portions, each having a different corresponding time delay distance component, at least one of said time delay distance components being smaller than a time delay distance which provides optimum cancellation at said ear locations.

75. The method as recited in claim 73, wherein said compensating signals are so arranged that each compensating audio component has a plurality of compensating audio portions, each having a different corresponding time delay distance component, at least one of said time delay distance components being greater than a time delay distance which provides optimum cancellation at said ear locations.

76. The method as recited in claim 73, wherein said compensating signals are so arranged that each compensating audio component has a plurality of compensating audio component portions, each having a different corresponding time delay distance component, at least one of said time delay distance components being greater than an optimum time delay distance, and at least one other of said time delay distance components being smaller than the optimum time delay distance, said optimum time delay distance providing optimum cancellation at said ear locations.

77. The method as recited in claim 76, wherein at least some of said compensating audio component portions have decibel values lower than a decibel value of its corresponding main audio component.

78. The apparatus as recited in claim 77, wherein at least one of said compensating audio component portions has a decibel value which varies with frequency, with lower frequencies of that compensating audio component portion having a higher decibel level than at higher frequencies of that compensating signal component.

79. The method as recited in claim 73, further comprising frequency equalizing said main audio components so that there is a higher decibel level for lower freqencies and a lower decibel level for higher frequencies.

80. A method to produce dimensionalized sound from right and left stereo signals which are characterized in that said signals are non-binaural signals having either a phase shift relationship between corresponding signal components, which phase shift relationship has a time delay distance greater than a time delay distance of a binaural phase shift for an ear spacing distance of a listener, or an amplitude difference greater than binaural amplitude differences of corresponding signal components, said method comprising:

a. providing left and right speaker means at right and left speaker locations, respectively, said speaker means arranged to transmit sounds to a listening location where there are right and left ear locations corresponding to right and left ear positions of a person's head which could be located at said listening location,
b. receiving said left stereo signal and providing a left main stereo output signal for said left speaker means,
c. receiving said right stereo signal and providing a right main stereo output signal for said right speaker means,
d. receiving said left stereo signal to produce an inverted left to right compensating signal corresponding to said left stereo signal for said right speaker means,
e. receiving said right stereo signal to produce an inverted right to left compensating signal corresponding to said right stereo signal for said left speaker means,
f. producing at said left speaker means:
   1. a left main audio component corresponding to said left main stereo output signal,
   2. a right to left compensating audio component corresponding to said right to left compensating signal,
g. producing at said right speaker means:
   1. a right main audio component corresponding to said right main stereo output signal,
   2. a left to right compensating audio component corresponding to said left to right compensating signal,
h. each of said two compensating audio components having a predetermined time delay distance relative to its corresponding main audio component within a predetermined time delay range, with the steps of said method being arranged and related to one another in a manner that:

a. said left main audio component has a primary path component from said left speaker means to said left ear location, and a secondary path component from said left speaker means to said right ear location, b. said right main audio component has a primary path component from said right speaker means to said right ear location, and a secondary path component from said right speaker means to said left ear location, c. the main left auido component reaches the left ear location without being cancelled a substantial amount, d. the right main audio component reaches the right ear location without being cancelled a substantial amount, e. the main left audio component travelling its secondary path to said right ear location is cancelled to a substantial amount by the left to right compensating audio component travelling from said right speaker means to said right ear location, f. the main right sound component travelling on the secondary path to said left ear location is cancelled to a substantial amount by the right to left compensating audio component travelling from said left speaker means to the left ear location, whereby a person positioned so that the person's head is at the listening location hears a dimensionalized sound with apparent sound sources being outside of the two speaker locations.

81. The method as recited in claim 80, wherein said compensating signals are so arranged that each compensating audio component has a plurality of compensating audio component portions, each having a different corresponding time delay distance component, at least one of said time delay distance components being smaller than a time delay distance which provides optimum cancellation at said ear locations.

82. The method as recited in claim 80, wherein said compensating signals are so arranged that each compensating audio component has a plurality of compensating audio component portions, each having a different corresponding time delay distance component, at least one of said time delay distance components being greater than a time delay distance which provides optimum cancellation at said ear locations.

83. The method as recited in claim 80, wherein said compensating signals are so arranged that each compensating audio component has a plurality of compensating audio component portions, each having a different corresponding time delay distance component, at least one of said time delay distance components being greater than an optimum time delay distance, and at least one other of said time delay distance components being smaller than the optimum time delay distance, said optimum time delay distance providing optimum cancellation at said ear locations.

84. The method as recited in claim 83, wherein at least some of said compensating audio component portions have decibel values lower than a decibel value of its corresponding main audio component.

85. The apparatus as recited in claim 84, wherein at least one of said compensating audio component portions has a decibel value which varies with frequency, with lower frequencies of that compensating audio component portion having a higher decibel level than at higher frequencies of that compensating signal component.

86. The method as recited in claim 80, further comprising frequency equalizing said main audio components so that there is a higher decibel level for lower frequencies and a lower decibel level for higher frequencies.

* * * * *